US010088804B2

(12) United States Patent
Cusin et al.

(10) Patent No.: US 10,088,804 B2
(45) Date of Patent: Oct. 2, 2018

(54) PAWL LOCK ASSEMBLY SYSTEM

(75) Inventors: Pierre Cusin, Villars-Burquin (CH); Arthur Queval, Neuchâtel (CH)

(73) Assignee: Nivarox-FAR S.A., Le Locle (CH)

( * ) Notice: Subject to any disclaimer, the term of this patent is extended or adjusted under 35 U.S.C. 154(b) by 1060 days.

(21) Appl. No.: 13/354,037

(22) Filed: Jan. 19, 2012

(65) Prior Publication Data

US 2012/0186054 A1 Jul. 26, 2012

(30) Foreign Application Priority Data

Jan. 26, 2011 (EP) ..... 11152202

(51) Int. Cl.

| | |
|---|---|
| ***B23P 19/04*** | (2006.01) |
| ***G04B 13/02*** | (2006.01) |
| ***G04B 15/14*** | (2006.01) |
| ***G04B 11/02*** | (2006.01) |

(52) U.S. Cl.

CPC ..... *G04B 11/028* (2013.01); *G04B 13/022* (2013.01); *G04B 15/14* (2013.01); *G04B 13/02* (2013.01); *Y10T 29/53613* (2015.01); *Y10T 29/53687* (2015.01); *Y10T 403/7061* (2015.01)

(58) Field of Classification Search

CPC .... G04B 11/028; G04B 13/022; G04B 13/02; Y10T 29/53613; Y10T 29/53687; Y10T 403/7009; Y10T 403/7011; Y10T 403/7013; Y10T 403/7047; Y10T 403/7049; Y10T 403/7061; Y10T 74/20636; F16D 1/0835; F16D 41/12

USPC ..... 29/225; 74/527, 575, 154, 152, 82, 108, 74/517, 577 SF, 89.2; 192/43.2, 219.5, 192/46; 368/320, 300, 32, 36, 191; 464/37

See application file for complete search history.

(56) References Cited

U.S. PATENT DOCUMENTS

| | | | | |
|---|---|---|---|---|
| 2,563,112 A * | 8/1951 | Hill | G04B 1/20 368/209 |
| 2,800,800 A * | 7/1957 | Dunn | F16D 3/06 403/359.2 |
| 3,200,918 A * | 8/1965 | Horn | F16D 41/12 192/46 |

(Continued)

FOREIGN PATENT DOCUMENTS

| | | |
|---|---|---|
| DE | 1922435 A1 | 11/1970 |
| DE | 2915526 * | 10/1980 |

OTHER PUBLICATIONS

European Search Report for EP 11 15 2202 dated Jul. 8, 2011.

*Primary Examiner* — Christopher M Koehler
*Assistant Examiner* — Mahdi H Nejad
(74) *Attorney, Agent, or Firm* — Sughrue Mion, PLLC

(57) ABSTRACT

The invention relates to a method (19, 19', 39, 39', 59, 59') of assembling a part (5, 5', 25, 25', 45, 45') in the aperture (18, 18', 38, 38', 58, 58') of a component (3, 3', 23, 23', 43, 43'). According to the invention, the assembly system (19, 19', 39, 39', 59, 59') includes a system (1, 1', 21, 21', 41, 41') of securing the component (3, 3', 23, 23', 43, 43') and the part (5, 5', 25, 25', 45, 45') to each other, which includes at least one pawl device (11, 11', 31, 31', 51, 51') intended to make the component (3, 3', 23, 23', 43, 43') and the part (5, 5', 25, 25', 45, 45') move integrally with each other. The invention concerns the field of timepieces.

21 Claims, 3 Drawing Sheets

(56) References Cited

U.S. PATENT DOCUMENTS 3,667,307 A * 6/1972 Kelch ..... F16D 41/18 192/12 B
3,928,862 A * 12/1975 Ivester ..... G03D 9/02 192/46
4,352,710 A * 10/1982 Makley ..... B65C 11/0247 101/288
4,401,006 A * 8/1983 Sekiguchi ..... G10F 1/06 192/46
4,570,769 A * 2/1986 Isaka ..... F16D 41/12 192/107 T
4,702,122 A * 10/1987 Richard ..... F16D 7/021 192/56.1
5,000,721 A * 3/1991 Williams ..... F16D 7/048 192/46
5,183,140 A * 2/1993 Nicoll ..... B65H 3/0808 192/56.1
5,590,550 A * 1/1997 Savkar ..... D06F 13/02 192/46
5,601,491 A * 2/1997 Chan ..... F16D 7/048 192/56.1
5,701,785 A * 12/1997 Liu ..... F03G 1/08 185/39
5,810,533 A * 9/1998 Nakamura ..... B24B 23/02 411/408
5,835,805 A * 11/1998 Izaki ..... G03B 17/425 396/411
6,374,696 B1 * 4/2002 Blake, III ..... B60H 1/0065 200/565
7,434,490 B2 * 10/2008 Hayashi ..... A63H 29/00 464/41
7,621,815 B2 * 11/2009 Bosserdet, Jr. ..... F16D 7/048 464/37
7,828,662 B2 * 11/2010 Hofschulte ..... F16D 7/002 464/30
7,941,076 B2 * 5/2011 Oohara ..... F16D 11/12 399/167
8,251,826 B2 * 8/2012 Lai ..... F16D 7/048 192/56.1
9,097,311 B2 * 8/2015 Fujisawa ..... F16H 35/10
9,163,692 B2 * 10/2015 Kojima ..... F16F 9/44
2007/0255102 A1 * 11/2007 Maruyama ..... A61B 1/0052 600/146
2009/0154303 A1 * 6/2009 Vaucher ..... G04B 13/022 368/322
2013/0237328 A1 * 9/2013 Billings ..... F16D 7/002 464/37
2016/0026154 A1 * 1/2016 Courvoisier ..... G04B 13/02 368/184
2017/0176935 A1 * 6/2017 Dubois ..... B22D 19/04

* cited by examiner

PAWL LOCK ASSEMBLY SYSTEM

This application claims priority from European Patent Application No. 11152202.5 filed Jan. 26, 2011, the entire disclosure of which is incorporated herein by reference.

FIELD OF THE INVENTION

The invention relates to a pawl lock assembly system and more specifically an assembly system of this type allowing the use of fragile material, i.e. which has no usable plastic domain.

BACKGROUND OF THE INVENTION

Current assemblies including a component made of fragile material such as silicon are generally secured by bonding. This type of operation requires extremely delicate application which makes it expensive.

SUMMARY OF THE INVENTION

It is an object of the present invention to overcome all or part of the aforementioned drawbacks, by providing a securing system that does not increase the thickness of the respective members and can be applied to fragile materials.

The invention therefore relates to a system of assembling a part in the aperture of a component, characterized in that it includes a system of securing the part and the component to each other which includes at least one pawl device intended to make the part and the component move integrally with each other.

The invention thus advantageously allows two elements to be secured to each other in the same plane, i.e. without any increase in the thickness of the elements, and without any plastic deformation which could, depending upon the nature of the materials, potentially be destructive.

In accordance with other advantageous features of the invention:

- Said at least one pawl device includes an elastic arm forming a pawl which locks a mortise and tenon type assembly to prevent any relative movements between the component and the part;
- The arm is formed in the component;
- The arm also forms the tenon, the mortise being formed in the part;
- The arm includes the mortise, the tenon being formed in the part;
- The arm forms a wall of the mortise, the rest of the mortise being formed in the component and the tenon being formed in the part;
- The arm is formed in the part;
- The arm also forms the tenon, the mortise being formed in the component;
- The arm includes the mortise, the tenon being formed in the component;
- The arm forms a wall of the mortise, the rest of the mortise being formed in the part and the tenon being formed in the component;
- The part is integral with an arbour for rotatably mounting the assembly comprising the part-component.

Finally, the invention relates to a timepiece, characterized in that it includes an assembly system according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
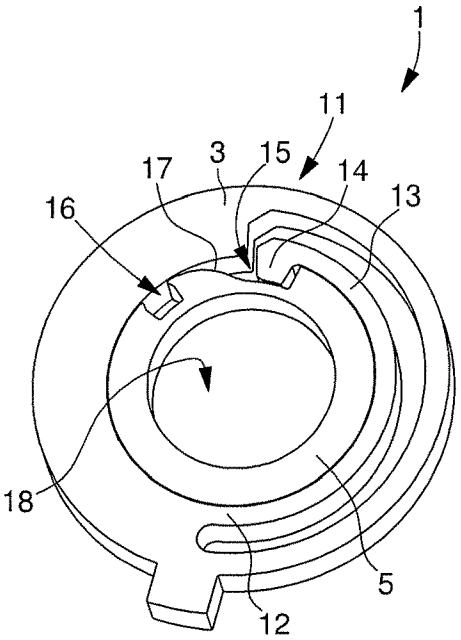
FIGS. 1 and 2 are diagrams of a first embodiment of a pawl device according to the invention.

As explained hereinbefore, the invention relates to an assembly system that can be applied to a fragile material, i.e. which has no plastic domain, such as a single crystal silicon-based material. This assembly system was devised for applications within the field of horology. However, other domains may very well be envisaged, such as, in particular aeronautics, jewellery or the automobile industry.

This assembly system is required within the field of horology owing to the increasing importance of fragile materials, such as those based on silicon, quartz, corundum or more generally ceramics. By way of example, it is possible to envisage forming the balance spring, balance, pallets, bridges or even wheel sets, such as the escape wheels, completely or partially from a base of fragile materials.

However, always being able to use ordinary steel arbours, the fabrication of which has been mastered, is a constraint which is difficult to reconcile with the use of parts having no plastic domain. Indeed, when tests were carried out, it was impossible to drive in a steel arbour and this systematically broke fragile parts, i.e. those with no plastic domain. For example, it became clear that the shearing generated by the metallic arbour entering the aperture in a silicon component systematically breaks the component.

This is why this Application proposes a system of assembling a part, which may be integral with an arbour, in the aperture of a component, which may form a rotatably mounted component, characterized in that it includes a system of securing the component and the part to each other which includes at least one pawl device intended to make the component and the part move integrally with each other.

Preferably, said at least one pawl device includes an elastic arm forming a pawl which locks a mortise and tenon type assembly to prevent any relative movements between the component and the part. It is thus clear that neither the component nor the part is subjected to plastic stress to secure them to each other.

The system of securing the component and the part to each other will become clearer with reference to FIGS. 1 to 9, which show non-exhaustive embodiments and variants of the invention. According to a first embodiment illustrated in FIGS. 1 and 2, the securing system 1 includes a single pawl device 11. The pawl device 11 includes an arm 13 which is made in component 3. Arm 13 is thus elastically mounted on component 3 at a first end 12, so as to form a pawl as explained hereinafter. Finally, arm 13 includes at the second free end thereof, a tenon 14 which projects into the substantially central aperture 18 in component 3.

Pawl device 11 also includes a mortise 16, formed in part 5 and intended to cooperate with tenon 14 of arm 13, in order to secure component 3 to part 5. FIG. 1 also shows that part 5 has a recess 15, which flares gradually away from mortise 16 and which is intended to form a cam 17 for tenon 14.

The pawl device 11 of system 1 for securing component 3 to part 5 is activated as explained hereinafter. First of all, component 3 and part 5 are fabricated. Of course, the steps of fabricating component 3 and part 5 do not have to observe any particular order and may even be performed at the same time.

Figure 2:
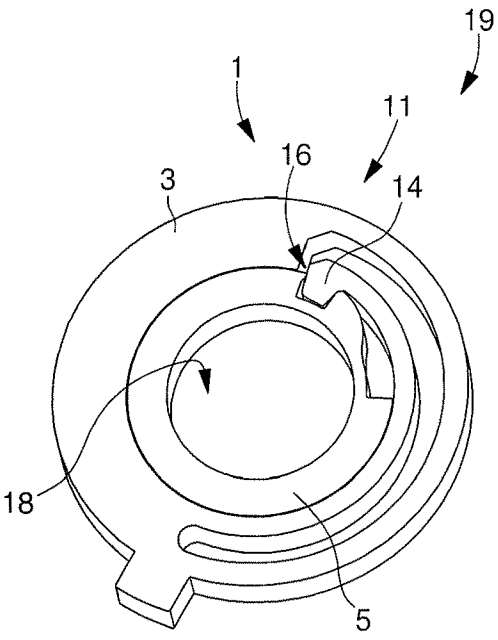

In a first phase, part 5 is inserted into aperture 18 of component 3 so that tenon 14 slides laterally into recess 15 of part 5 as illustrated in FIG. 1. In a second phase, a relative movement of rotation is then imparted to part 5 with respect to component 3, in order to slide tenon 14 against cam 17 so as to gradually move tenon 14 away from part 5. The relative movement continues until tenon 14 tips into mortise 16, so that the assembly comprising mortise 16-tenon 14 is locked by pawl arm 13, as illustrated in FIG. 2.

It is thus clear that tenon 14 of component 3 is made to move integrally with mortise 16 of part 5, i.e. whatever movement is made, under the stress resulting from the elastic return of pawl arm 13. An assembly system 19 is thus obtained wherein the securing system 1 does not require any increase in the thickness of the members, i.e. in component 3 and part 5, and which can be applied in particular to fragile materials.

Of course, securing system 1 may include several pawl devices 11, mounted around aperture 18 in component 3. Likewise, component 3 may form all or part of a balance spring, balance, pallets, bridge or even a wheel set such as an escape wheel. Similarly, part 5 may be secured to an arbour, a pin or more generally any element in one piece, i.e. made as a single piece or using several components.

Figure 3:
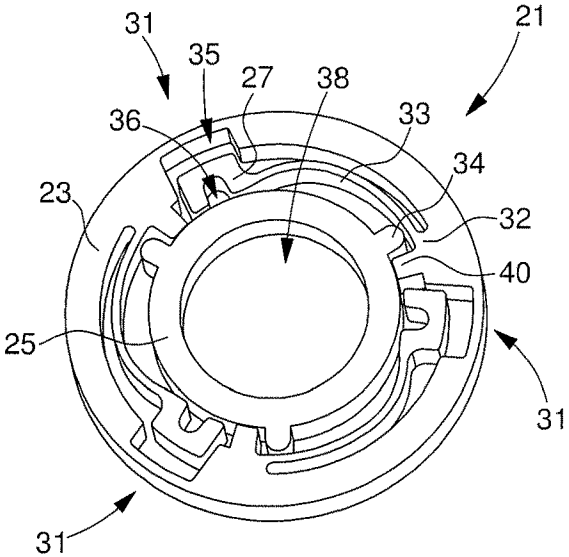
FIGS. 3 and 4 are diagrams of a second embodiment of pawl device according to the invention.
Figure 4:
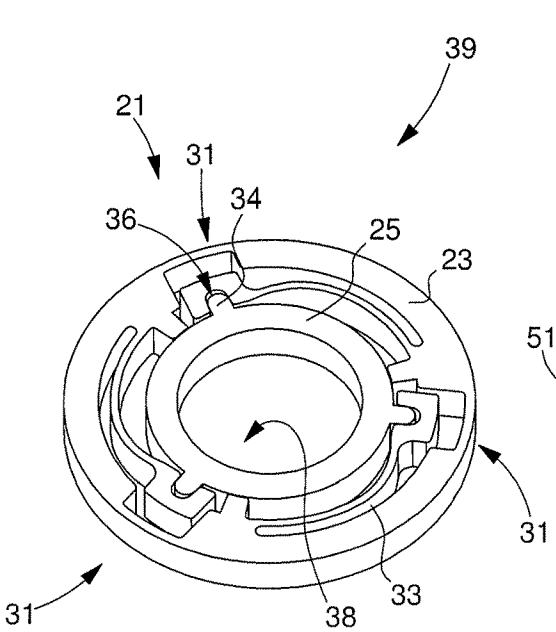

According to a second embodiment illustrated in FIGS. 3 and 4, the system 21 for securing component 23 and part 25 to each other includes three pawl devices 31. Each pawl device 31 includes a pawl arm 33, which is made in component 23. Arm 33 is thus elastically mounted on component 23 at a first end 32 so as to form a pawl, as explained hereinafter. Finally, at the second free end 27 thereof, arm 33 includes a mortise 36, which projects into the substantially central aperture 38 in component 23.

Each pawl device 31 also includes a tenon 34, formed in part 25 and intended to cooperate with the mortise 36 of an arm 33, in order to secure component 23 to part 25. FIG. 3 also shows that component 23 has a recess 35, which faces each free end 27 of an arm 33 including a mortise 36 and which is intended to create the clearance necessary for the elastic movement of said arm. Finally, for each pawl device 31, component 23 includes a stop member 40 for centring part 25 in aperture 38.

The pawl device 31 of system 21 for securing component 23 to part 25 is activated as explained hereinafter. First of all, component 23 and part 25 are fabricated. Of course, the steps of fabricating component 23 and part 25 do not have to observe any particular order and may even be performed at the same time.

In a first phase, part 25 is inserted into aperture 38 of component 23 so that tenon 34 slides substantially against stop member 40 of part 23, as illustrated in FIG. 1. In a second phase, a relative movement of rotation is then imparted to part 25 with respect to component 23, in order to slide tenon 34 against arm 33 so as to gradually move the free end 27 of arm 33 away from part 25. It is clear that during this relative movement, the free end 27 of arm 33 including mortise 36, is thus gradually moved towards recess 35. The relative movement continues until mortise 36 tips, covering tenon 34, so that the assembly comprising mortise 36-tenon 34 is locked by pawl arm 33, as illustrated in FIG. 4.

It is thus clear that tenon 34 of part 25 is made to move integrally with mortise 36 of component 23, i.e. whatever movement is made, under the stress resulting from the elastic return of pawl arm 33. An assembly system 39 is thus obtained wherein the securing system 21 does not require any increase in the thickness of the members, i.e. in component 23 and part 25, and which can be applied in particular to fragile materials.

Of course, securing system 21 may include more or fewer pawl devices 31, mounted around aperture 38 in component 23. Likewise, component 23 may form all or part of a balance spring, balance, pallets, bridge or even a wheel set such as an escape wheel. Similarly, part 25 may be secured to an arbour, a pin or more generally any element in one piece, i.e. made as a single piece or using several components.

Figure 6:
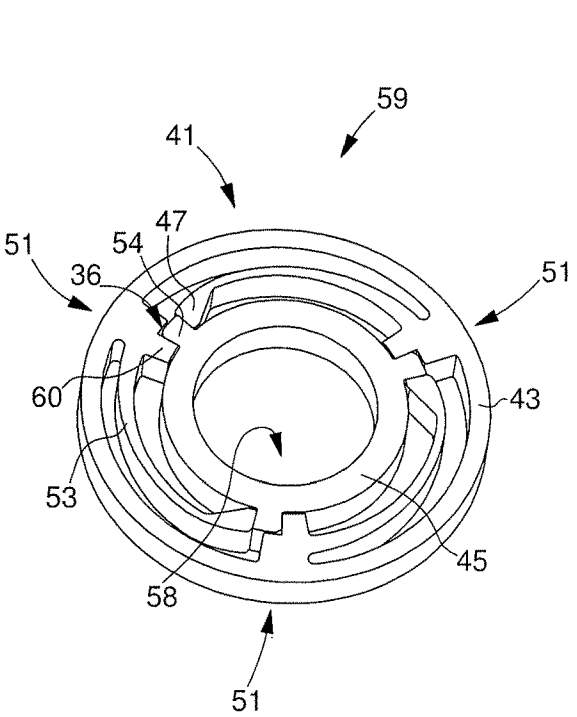
FIGS. 5 and 6 are diagrams of a third embodiment of a pawl device according to the invention.
Figure 5:
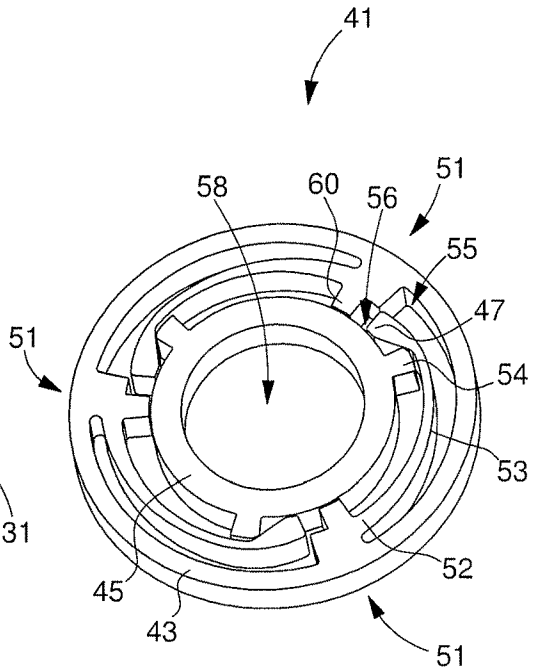

According to a third embodiment illustrated in FIGS. 5 and 6, the system 41 for securing component 43 and part 45 to each other includes three pawl devices 51. Each pawl device 51 includes a pawl arm 53, which is made in component 43. Arm 53 is thus elastically mounted on component 43 at a first end 52 so as to form a pawl as explained hereinafter. Finally, at the second free end thereof, arm 53 includes a flange 47, intended to form a wall of mortise 56, which projects into the substantially central aperture 58 in component 43. Moreover, for each pawl device 51, component 43 includes a stop member 60, intended both to centre part 45 in aperture 58 and to form the rest of mortise 56, in cooperation with flange 47.

Each pawl device 51 also includes a tenon 54, formed in part 45 and intended to cooperate with mortise 56, formed by stop member 60 and flange 47, so as to secure component 43 to part 45. FIG. 5 also shows that component 43 has a recess 55, which faces each flange 47 of an arm 53 and which is intended to create the clearance necessary for the elastic movement of said arm.

The pawl device 51 of system 41 for securing component 43 to part 45 is activated as explained hereinafter. First of all, component 43 and part 45 are fabricated. Of course, the steps of fabricating component 43 and part 45 do not have to observe any particular order and may even be performed at the same time.

In a first phase, part 45 is inserted into aperture 58 of component 53, as illustrated in FIG. 1. In a second phase, a relative movement of rotation is then imparted to part 45 with respect to component 43, in order to slide the top portion of tenon 54 against arm 53, so as to gradually move the flange 47 of arm 53 away from part 45. It is clear that during this relative movement, the flange 47 of arm 53 is thus gradually moved towards recess 55. The relative movement continues until flange 47 tips, laterally locking tenon 54, so that tenon 54 is elastically trapped between the assembly comprising stop member 60-flange 47 forming mortise 56 by pawl arm 53, as illustrated in FIG. 6.

It is thus clear that tenon 54 of part 45 is made to move integrally with mortise 56 of component 53, i.e. whatever movement is made, under the stress resulting from the elastic return of pawl arm 53. An assembly system 59 is thus obtained wherein the securing system 41 does not require any increase in the thickness of the members, i.e. in component 43 and part 45, and which can be applied in particular to fragile materials.

Of course, securing system 41 may include more or fewer pawl devices 51, mounted around aperture 58 in component 43. Likewise, component 43 may form all or part of a balance spring, balance, pallets, bridge or even a wheel set such as an escape wheel. Similarly, part 45 may be secured to an arbour, a pin or more generally any element in one piece, i.e. made as a single piece or using several components.

Figure 9:
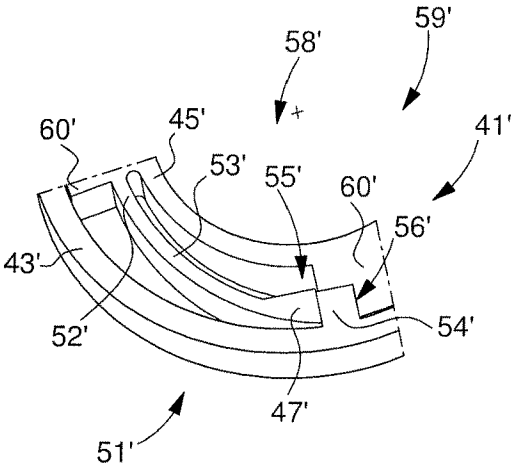
FIGS. 7 to 9 are partial views of variants of the three embodiments of a pawl device according to the invention.
Figure 8:
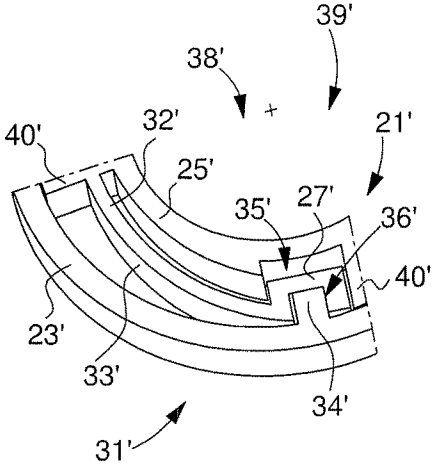

The three embodiments shown in FIGS. 1 to 6 all have in common an arm 13, 33, 53, which is elastically mounted on the component 3, 23, 43. It is clear that the invention is not limited to this feature. Thus, FIGS. 7 to 9 show variants of the three embodiments hereinabove wherein the arms 13', 33', 53' are elastically mounted on part 5', 25', 45'.

Figure 7:
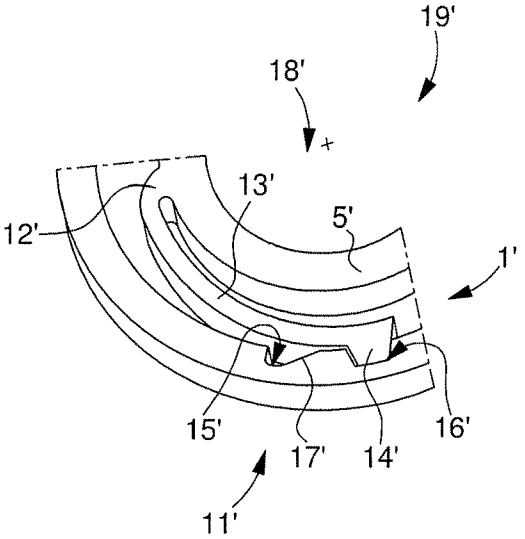

According to a variant of the first embodiment illustrated in FIG. 7, the securing system 1' includes at least one pawl device 11', which has an arm 13' elastically mounted on part 5' at a first end 12', so as to form a pawl. Moreover, arm 13' includes a tenon 14' at the second free end thereof. The pawl device 11' also includes a mortise 16', formed in component 3' and intended to cooperate with the tenon 14' of arm 13', in order to secure component 3' to part 5' in the opposite manner to the first embodiment.

Thus, in a first phase, part 5' is inserted into the aperture 18' of component 3', so that tenon 14' slides laterally into recess 15' of component 3'. In a second phase, a relative movement of rotation is then imparted to part 5' with respect to component 3', so as to slide tenon 14' against cam 17', in order to gradually move tenon 14' away from component 3'. The relative movement continues until tenon 14' tips into mortise 16', so that the assembly comprising mortise 16'-tenon 14' is locked by pawl arm 13', as illustrated in FIG. 7.

Consequently, the FIG. 7 variant therefore forms an assembly system 19' wherein the tenon 14' of part 5' moves integrally with mortise 16' of component 3', i.e. whatever movement is made, under the stress resulting from the elastic return of pawl arm 13', with the same advantages, applications or alternatives as set forth for the first embodiment.

According to a variant of the second embodiment illustrated in FIG. 8, the securing system 21' includes at least one pawl device 31' which includes an arm 33', elastically mounted on the part 25' at a first end 32' so as to form a pawl. Moreover, the arm 33' includes a mortise 36' at the second free end 27' thereof. The pawl device 31' also includes a tenon 34', formed in component 23' and intended to cooperate with the mortise 36' of arm 33', in order to secure component 23' to part 25' in the opposite manner to the second embodiment. Finally, for each pawl device 31', component 25' includes a stop member 40' for centring part 25' in aperture 38'.

Thus, in a first phase, part 25' is inserted into the aperture 38' of component 23'. In a second phase, a relative movement of rotation is then imparted to part 25' with respect to component 23', in order to slide tenon 34' against arm 33' so as to gradually move the free end 27' away from component 23', moving it closer to recess 35'. The relative movement continues until mortise 36' tips, covering tenon 34', so that the assembly comprising mortise 36'-tenon 34' is locked by pawl arm 33', as illustrated in FIG. 8.

Consequently, the FIG. 8 variant therefore forms an assembly system 39' wherein the tenon 34' of component 23' is made to move integrally with mortise 36' of part 25', i.e. whatever movement is made, under the stress resulting from the elastic return of pawl arm 33', with the same advantages, applications or alternatives as set forth for the second embodiment.

According to a third embodiment illustrated in FIG. 9, the system 41' for securing component 43' and part 45' to each other includes at least one pawl device 51', which includes an arm 53', elastically mounted on part 45' at a first end 52' so as to form a pawl. Further, the second free end of arm 53' includes a flange 47', which is intended to form a wall of mortise 56' with a stop member 60' formed in part 45'. Preferably, as in the third embodiment, stop member 60' is also intended to centre part 45' in aperture 58'.

The pawl device 51' also includes a tenon 54', formed in component 43' and intended to cooperate with the mortise 56' formed by stop member 60' and flange 47', so as to secure component 43' to part 45' in the opposite manner to the third embodiment. Further, part 45' has a recess 55', which is opposite flange 47' of arm 53', so as to create the clearance necessary for the elastic movement of said arm.

Thus, in a first phase, part 45' is inserted into the aperture 58' of component 53'. In a second phase, a relative movement of rotation is then imparted to part 45' with respect to component 43', in order to slide the top portion of tenon 54' against arm 53', so as to gradually move flange 47' away from component 43', moving it gradually closer to recess 55'. The relative movement continues until flange 47' tips, laterally locking tenon 54', so that tenon 54' is elastically trapped between the assembly comprising stop member 60'-flange 47' forming mortise 56', by pawl arm 53', as illustrated in FIG. 9.

Consequently, the variant of FIG. 9 thus forms an assembly system 59' wherein the tenon 54' of component 43' is made to move integrally with the mortise 56' of part 55', i.e. whatever movement is made, under the stress resulting from the elastic return of pawl arm 53', with the same advantages, applications or alternatives as set forth for the third embodiment.

Of course, the present invention is not limited to the illustrated example, but is capable of various variants and alterations which will appear to those skilled in the art. In particular, it should be mentioned, by way of example, that for all of the embodiments and/or their variants, the component 3, 3', 23, 23', 43, 43' and/or the part 5, 5', 25, 25', 45, 45' may be formed by a LIGA type process, i.e. photolithography of a mould followed by filling the mould by galvanoplasty or by a photolithography process using a mask, followed by an etching step of the pierced holes of the mask.

Consequently, the component 3, 3', 23, 23', 43, 43' and/or the part 5, 5', 25, 25', 45, 45' may be formed from many materials such as, for example, metal, metal alloy, from a non-metallic material base or even from any oxide, nitride or carbide base.

It is also perfectly possible to envisage the component 3, 3', 23, 23', 43, 43' and/or the part 5, 5', 25, 25', 45, 45' including at least two levels with distinct patterns in order to provide additional functions, such as for example, a shoulder for axially locking the assembly system 19, 19', 39, 39', 59, 59'.

In the case of the first embodiment and the variant thereof illustrated in FIGS. 1, 2 and 7, it is not compulsory to provide recess 15, 15' forming cam 17, 17'. It is possible simply to provide the mortise 16, 16' on part 5 and component 3' respectively.

Finally, upon reading the embodiments and variants hereinbefore, it is clear that, depending upon the application, the assembly systems 19, 19', 39, 39', 59, 59' can be of different dimensions or shapes, particularly as regards the arm 13, 13', 33, 33', 53, 53', of the tenon 14, 14', 34, 34', 54, 54' and/or the mortise 16, 16', 36, 36', 56, 56' without departing from the scope of the invention.

What is claimed is:

1. A timepiece comprising a system for assembling a part in an aperture of a component, the system for assembling comprising a system for securing the component and the part to each other in a same plane, the system for securing comprising at least one pawl device configured to lock the component and the part such that, once the component and the part are locked, the component and the part are locked in a final assembled configuration and move integrally with each other, wherein the locking of the component and the part prevents the component and the part from slipping relative to one another in all directions once the component and the part are locked, wherein the system for securing does not comprise a clutch mechanism, and wherein, once the component and the part are locked, the component and the part are unable to be unlocked without destroying the system.

2. The timepiece according to claim 1, wherein each of said at least one pawl device comprises an elastic arm forming at least one pawl, which locks a mortise and tenon type assembly to prevent any relative movements between the component and the part.

3. The timepiece according to claim 2, wherein the arm is formed in the component.

4. The timepiece according to claim 3, wherein the arm also forms the tenon, the mortise being formed in the part.

5. The timepiece according to claim 3, wherein the arm includes the mortise, the tenon being formed in the part.

6. The timepiece according to claim 3, wherein the arm forms a wall of the mortise, the remainder of the mortise being formed in the component and the tenon being formed in the part.

7. The timepiece according to claim 2, wherein the arm is formed in the part.

8. The timepiece according to claim 7, wherein the arm also forms the tenon, the mortise being formed in the component.

9. The timepiece according to claim 7, wherein the arm comprises the mortise, the tenon being formed in the component.

10. The timepiece according to claim 7, wherein the arm forms a wall of the mortise, the remainder of the mortise being formed in the part and the tenon being formed in the component.

11. The timepiece according to claim 1, wherein the part is integral with an arbour configured to rotatably mount an assembly comprising the part and the component.

12. A timepiece comprising a system for assembling a part in an aperture of a component, the system for assembling comprising a system for securing the component and the part to each other on a same plane, the system for securing comprising at least one pawl device configured to lock the component and the at least one pawl device such that, once the component and the at least one pawl device are locked, the component and the part are locked in a final assembled configuration and rotate substantially integral with each other along the same plane to prevent relative movement between the component and the part, wherein the locking of the component and the part prevents the component and the part from slipping relative to one another in all directions once the component and the at least one pawl device are locked, wherein the system for securing does not comprise a clutch mechanism, and wherein, once the component and the part are locked, the component and the part are unable to be unlocked without destroying the system.

13. The timepiece according to claim 12, wherein the at least one pawl device is further configured to lock the component to the part to prevent bidirectional relative rotational movement between the component and the part along the same plane.

14. The timepiece according to claim 12, wherein each of said at least one pawl device comprises an elastic arm forming at least one pawl, the at least one pawl locking a mortise and tenon type assembly to prevent bidirectional relative rotational movement between the component and the part along the same plane.

15. The timepiece according to claim 14, wherein the elastic arm is formed in the component.

16. The timepiece according to claim 15, wherein the elastic arm also forms a tenon, a mortise being formed in the part.

17. The timepiece according to claim 15, wherein the elastic arm includes a mortise, the tenon being formed in the part.

18. The timepiece according to claim 15, wherein the elastic arm forms a wall of a mortise, the remainder of the mortise being formed in the component and a tenon being formed in the part.

19. The timepiece according to claim 14, wherein the elastic arm is formed in the part.

20. The timepiece according to claim 19, wherein the elastic arm also forms a tenon, a mortise being formed in the component.

21. A timepiece comprising a system for assembling a part in an aperture of a component, the system for assembling comprising a system for securing the component and the part to each other in a same plane, the system for securing comprising at least one pawl device configured to lock the component and the part such that, once the component and the part are locked, the component and the part are locked in a final assembled configuration and move integrally with each other, wherein the locking of the component and the part prevents the component and the part from slipping relative to one another in all directions once the component and the part are locked, wherein the system for securing does not comprise a clutch mechanism, wherein the part has at least one stop and at least one mortise and at least one ramp connecting the at least one stop with the at least one mortise and the component has the at least one pawl and a tenon on each of the at least one pawl, and wherein the part and the component are rotatable relative to one another until the tenon of the component is stopped by the stop of the part and then they rotate together, and wherein the part and the component are rotatable relative to one another until the tenon of the component is locked in the mortise of the part to move integrally with each other.

* * * * *